US008025011B1

(12) United States Patent
Yafai et al.

(10) Patent No.: US 8,025,011 B1
(45) Date of Patent: Sep. 27, 2011

(54) STUN GRENADE

(75) Inventors: Yusif Yafai, Flanders, NJ (US); Matthew P. Evangelisti, Denville, NJ (US); Lidija Kotevska, Bloomingdale, NJ (US); Stojan Kotevski, Bloomingdale, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 228 days.

(21) Appl. No.: 12/041,686

(22) Filed: Mar. 4, 2008

(51) Int. Cl.
*F42B 27/00* (2006.01)

(52) U.S. Cl. ..... 102/487

(58) Field of Classification Search ..... 102/355, 102/368, 482, 487, 488, 498, 502
See application file for complete search history.

(56) References Cited

U.S. PATENT DOCUMENTS

| | | | | |
|---|---|---|---|---|
| 1,894,203 | A * | 1/1933 | Spring | 102/368 |
| 6,257,146 | B1 * | 7/2001 | Stonebraker | 102/346 |
| 7,173,540 | B2 * | 2/2007 | Daigle et al. | 340/815.83 |
| 7,191,708 | B2 * | 3/2007 | Ouliarin | 102/502 |
| 2005/0188885 | A1 * | 9/2005 | Daigle et al. | 102/502 |
| 2006/0230972 | A1 * | 10/2006 | Ouliarin | 102/487 |

* cited by examiner

*Primary Examiner* — Bret Hayes
(74) *Attorney, Agent, or Firm* — John F. Moran

(57) ABSTRACT

A stun grenade includes a housing having at least a portion that is not opaque; a light output section disposed in the housing, the light output section comprising a pyrotechnic material; a fuze coupled to the housing, the fuze including a time delay column inserted into the housing; and a noise output section comprising a lower portion of the time delay column and a pyrotechnic material disposed in the lower portion of the time delay column. The light output section and the noise output section are initiated at different times.

14 Claims, 2 Drawing Sheets

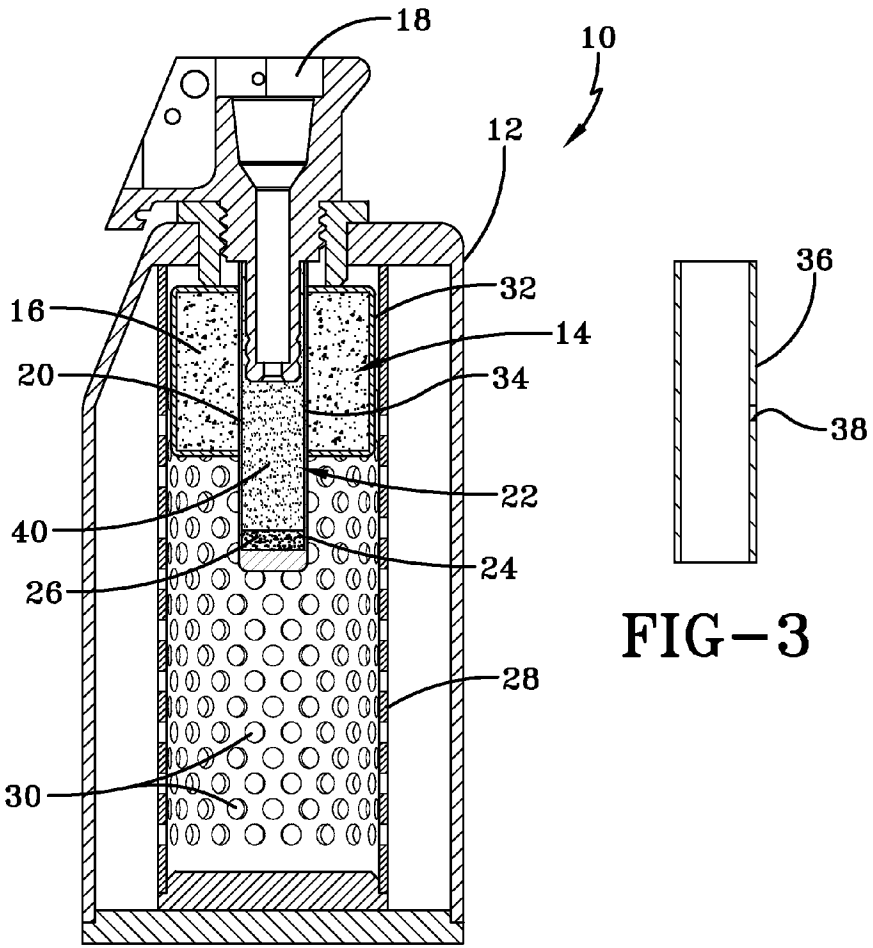
FIG-3
FIG-2
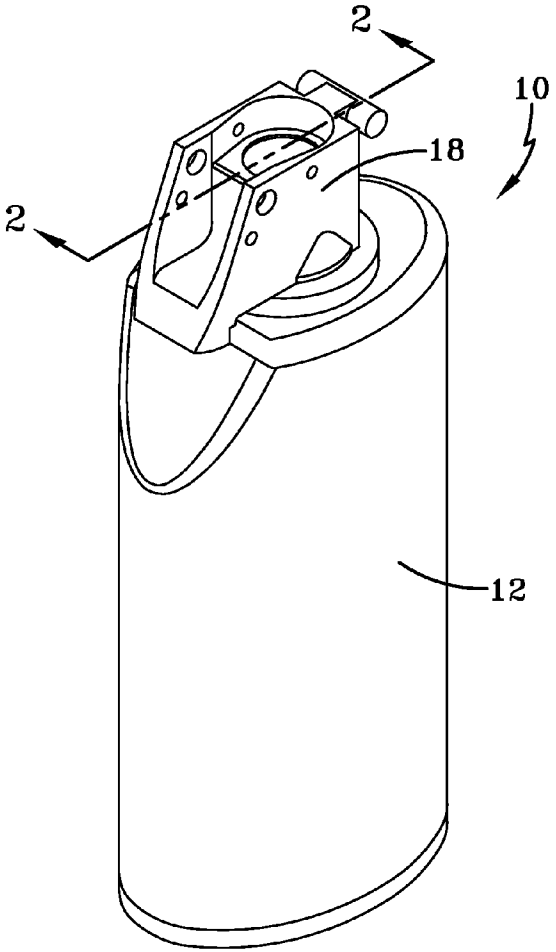
FIG-1

STUN GRENADE

STATEMENT OF GOVERNMENT INTEREST

The inventions described herein may be manufactured, used and licensed by or for the U.S. Government for U.S. Government purposes.

BACKGROUND OF THE INVENTION

The invention relates in general to stun grenades and in particular to flash-bang type stun grenades.

To shock and distract an adversary during a forced entry, the adversary can be shocked by creating a loud noise and a bright flash. Currently there are "flash-bang" stun grenades on the market that accomplish this through a pyrotechnic (energetic) means. The pyrotechnic approach to creating the "flash-bang" has limitations because the pyrotechnic mix is an integral combination of the flash and bang mixes. An advantage would be gained if each feature were to be independent of the other. Additionally, the current pyrotechnic design technology is limited in its ability to prevent the combustion of adjacent materials as the stun grenade is initiated. The violent reaction of the energetics is difficult to control using known designs.

It is an object of the invention to provide a flash-bang stun grenade having separate flash and bang sections.

One aspect of the invention is a stun grenade comprising a housing having at least a portion that is not opaque; a light output section disposed in the housing, the light output section comprising a pyrotechnic material; a fuze coupled to the housing, the fuze including a time delay column inserted into the housing; and a noise output section comprising a lower portion of the time delay column and a pyrotechnic material disposed in the lower portion of the time delay column.

The grenade may further comprise a protective cover disposed around at least the noise output section.

In one embodiment, the light output section may comprise a second housing having at least a portion that is not opaque, the second housing being disposed in an upper portion of the housing, the time delay column being inserted through the second housing, and the time delay column including a port that opens into the second housing.

In a second embodiment, the housing may comprise upper and lower portions, the upper portion housing the noise output section and the lower portion housing the light output section.

The second embodiment may further comprise a firing pin disposed adjacent a bottom of the time delay column and a primer charge disposed adjacent the firing pin, the primer charge communicating with the light output section.

Another aspect of the invention is a method of using a stun grenade comprising igniting a light output section at a first time; and igniting a noise output section at a second time that is different than the first time.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

FIG. 1 is a perspective view of an embodiment of a stun grenade.

FIG. 2 is a sectional view of the stun grenade of FIG. 1.

FIG. 3 is a sectional view of a sleeve.

DETAILED DESCRIPTION OF THE PREFERRED EMBODIMENTS

Figure 5:
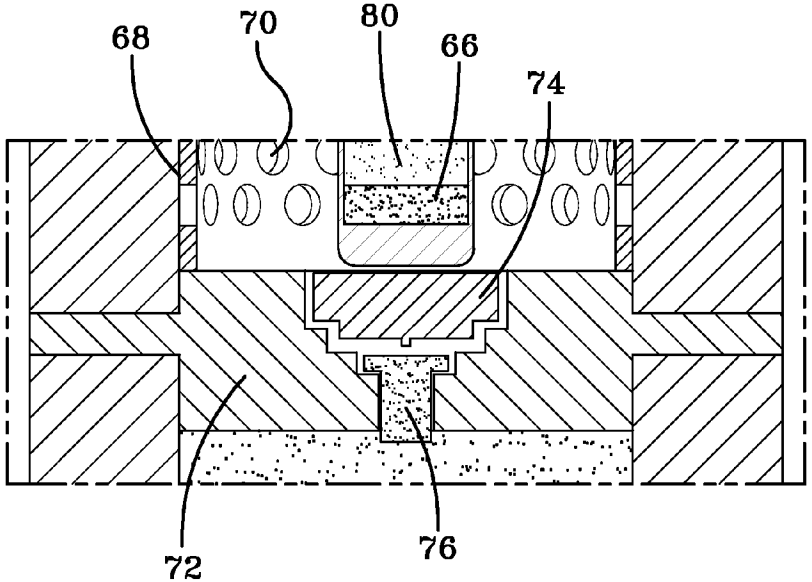
FIG. 5 is an enlarged view of a portion of FIG. 4.

In the invention, the light (flash) and sound (bang) output are isolated into individual events. An advantage of isolating the flash and the bang is that more or less of either reaction can be created without affecting the other. So, if the intensity of the flash (candlepower) needs to be increased, the brightness can be adjusted without affecting the noise level. Additionally, isolating the flash and the bang allows one to control the timing of either the flash or the bang.

An advantage of flash-bang grenades with variable timing delays is the ability to tailor or maximize the shock factor for various forced entry scenarios. Additionally, the total amount of energetic material used can be reduced by separating the flash and the bang. Unlike the prior art, the invention eliminates the simultaneous creation of flash and bang. Simultaneous initiation requires that only certain energetics can be used. On the other hand, the invention can use less violent energetic reactions to create a similar flash and/or bang.

In one embodiment of the invention, the flash occurs before the bang. In another embodiment of the invention, the bang occurs before the flash.

FIG. 1 is a perspective view of an embodiment of a stun grenade 10. FIG. 2 is a sectional view of the stun grenade 10 of FIG. 1. In the stun grenade 10, the flash occurs before the bang. Grenade 10 includes a housing 12, a light output section 14, a fuze 18 coupled to the housing 12, and a noise output section 22. Fuze 18 includes a time delay column 20 inserted in housing 12. The noise output section 22 includes a lower portion 24 of the time delay column 20. A pyrotechnic material 26 is disposed in the lower portion 24. Ignition of the pyrotechnic material 26 causes the bang or noise. Disposed above pyrotechnic material 26 in delay column 20 is a flammable material 40 that provides a time delay, as is well-known in the art.

The light output section 14 includes a housing 32 containing pyrotechnic material 16 for producing the flash. Pyrotechnic material 16 can be, for example, magnesium wire or powder. At least a portion of the housing 32 is not opaque and the entire housing 32 may be translucent or transparent. Similarly, at least a portion of the housing 12 is not opaque and the entire housing 12 may be translucent or transparent. Housings 12 and 32 may comprise, for example, glass or a polycarbonate. Housing 32 is disposed in an upper portion of the housing 12. The time delay column 20 is inserted through the housing 32. Housing 32 can have a donut-like shape to accommodate the time delay column 20.

The time delay column 20 includes a port 34 that opens into housing 32. A thin seal can be used to close port 34. When the grenade 10 is initiated, the flammable material 40 in the time delay column 20 burns and causes ignition of the pyrotechnic material 16 via port 34. Pyrotechnic material 16 produces the flash. The flammable material 40 continues burning downward and ignites the pyrotechnic material 26 that produces the bang. The fuze and time delay column of a standard U.S. Army fragmentation grenade may be used in the stun grenade 10, with the addition of port 34.

A protective cover 28 is disposed around at least the noise output section 22 and can also be disposed around the light output section 14. The protective cover 28 can comprise a semi-rigid material having passageways 30 there through, such as plastic foam or sponge-like material. To better contain fragments, the passageways 30 are maze-like or labyrinthian. The cover 28 can also absorb toxic gases.

For further protection from fragments, a cylindrical sleeve 36 (FIG. 3) may be disposed around the time delay column 20. The sleeve 36 can comprise metal or plastic. A port 38 is formed in sleeve 36 and aligned with port 34 in the time delay column 20.

Figure 4:
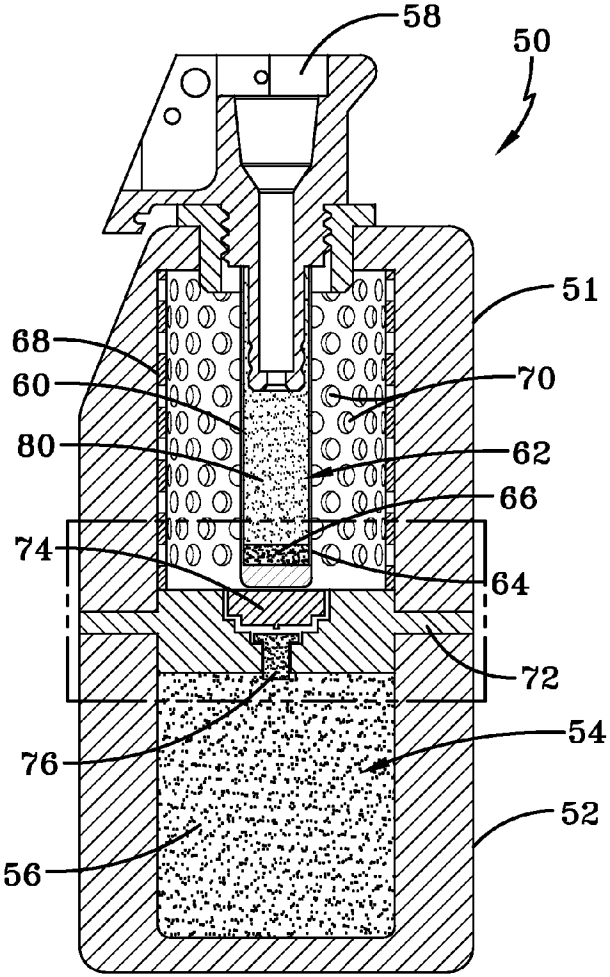
FIG. 4 is a sectional view of a second embodiment of a stun grenade.

FIG. 4 is a sectional view of a second embodiment of a stun grenade 50. FIG. 5 is an enlarged view of a portion of FIG. 4. In the stun grenade 50, the flash occurs before the bang. Grenade 50 comprises a housing having upper and lower portions 51, 52. The upper portion 51 houses the noise output section 62 and the lower portion 52 houses the light output section 54. A fuze 58 is coupled to the upper portion 51 of the housing. Fuze 58 includes a time delay column 60 inserted in the upper portion 51 of the housing. The fuze and time delay column of a standard U.S. Army fragmentation grenade may be used in the stun grenade 50.

The noise output section 62 includes a lower portion 64 of the time delay column 60. A pyrotechnic material 66 is disposed in the lower portion 64. Ignition of the pyrotechnic material 66 causes the bang or noise. Disposed above pyrotechnic material 66 in delay column 60 is a flammable material 80 that provides a time delay, as is well-known in the art.

The light output section 54 contains pyrotechnic material 56 for producing the flash. Pyrotechnic material 56 can be, for example, magnesium wire or powder. At least part of the lower portion 52 of the housing is not opaque and may be translucent or transparent. Housing portions 51, 52 may comprise, for example, glass or a polycarbonate. Housing portions 51, 52 can be joined in a variety of ways, for example, threads, adhesive, welding, etc.

A support member 72 is disposed below the noise output section 62 and supports a firing pin 74. When the grenade 50 is initiated, the flammable material 80 in the time delay column 60 burns and causes ignition of the pyrotechnic material 66. Pyrotechnic material 66 produces the bang. Detonation of the pyrotechnic material 66 forces firing pin 74 into primer charge 76. Primer charge 76 ignites pyrotechnic material 56, which produces the flash.

A protective cover 68 is disposed around at least the noise output section 62. The protective cover 68 can comprise a semi-rigid material having passageways 70 there through, such as plastic foam or sponge-like material. To better contain fragments, the passageways 70 are maze-like or labyrinthian. The cover 68 can also absorb toxic gases.

For further protection from fragments, a cylindrical sleeve (not shown) similar to the sleeve 36 of FIG. 3 may be disposed around the time delay column 60. The sleeve need not include the port 38 shown in FIG. 3.

An advantage of the inventive stun grenade is that much of the energetic material of known stun grenades can be replaced with alternate materials that are less toxic but still provide the required noise and light outputs. In addition, the sum of the explosive outputs of the flash and bang sections of the invention can be much less than the explosive output of a conventional stun grenade, because of the separation of the flash and bang materials. Thus, users of the stun grenade are safer.

The invention may be used not only for hostile enclosure raids, but can be used to complement crowd control (especially in dark areas) devices, police, surveillance and security activities. The invention can also be used as a personal protection device.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. A stun grenade, comprising:

a housing having at least a portion that is not opaque;

a light output section disposed in the housing, the light output section comprising a pyrotechnic material;

a fuze coupled to the housing, the fuze including a time delay column inserted into the housing; and a noise output section comprising a lower portion of the time delay column and a pyrotechnic material disposed in the lower portion of the time delay column wherein the light output section comprises a second housing having at least a portion that is not opaque, the second housing being disposed in an upper portion of the housing, the time delay column being inserted through the second housing, and the time delay column including a port that opens into the second housing.

2. The grenade of claim 1 further comprising a sleeve disposed around the time delay column, the sleeve including a port adjacent the port in the time delay column.

3. The grenade of claim 1 further comprising a protective cover disposed around the light output section and the noise output section.

4. The grenade of claim 3 wherein the protective cover comprises a material with labyrinthian passageways.

5. A stun grenade, comprising:

a housing having at least a portion that is not opaque;

a light output section disposed in the housing, the light output section comprising a pyrotechnic material;

a fuze coupled to the housing, the fuze including a time delay column comprising flammable material inserted into the housing;

a noise output section comprising a lower portion of the time delay column and a pyrotechnic material disposed in the lower portion of the time delay column wherein the housing comprises upper and lower portions, the upper portion housing the noise output section and the lower portion housing the light output section, and a firing pin disposed adjacent a bottom of the time delay column and a primer charge disposed adjacent the firing pin, the primer charge communicating with the light output section.

6. The grenade of claim 5 further comprising a protective cover having a structural configuration disposed around at least the noise output section for entrapping flying debris from an energetics reaction of the noise section.

7. The grenade of claim 6 wherein the protective cover comprises a semi-rigid material having passageways therethrough.

8. The grenade of claim 7 wherein the passageways include labyrinthian passageways.

9. The grenade of claim 5 wherein the pyrotechnic material in the light output section comprises magnesium.

10. The grenade of claim 5 wherein the housing is transparent.

11. The grenade of claim 5 further comprising a protective cover disposed around the noise output section.

12. The grenade of claim 11 wherein the protective cover comprises a semi-rigid material with labyrinthian passageways.

13. The grenade of claim 5 wherein the pyrotechnic material in the light output section comprises magnesium.

14. The grenade of claim 5 wherein the lower portion of the housing is transparent.

* * * * *